US006531399B2

(12) United States Patent
Kojima et al.

(10) Patent No.: US 6,531,399 B2
(45) Date of Patent: Mar. 11, 2003

(54) POLISHING METHOD

(75) Inventors: Hiroyuki Kojima, Kawasaki (JP); Tetsuo Ohkawa, Yokohama (JP); Hidemi Sato, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/949,642

(22) Filed: Sep. 12, 2001

(65) Prior Publication Data

US 2002/0076838 A1 Jun. 20, 2002

(30) Foreign Application Priority Data

Oct. 26, 2000 (JP) ..... 2000-332134

(51) Int. Cl.[7] ..... H01L 21/461
(52) U.S. Cl. ..... 438/692
(58) Field of Search ..... 451/41; 437/228; 216/86; 438/14, 692, 5, 345; 156/345

(56) References Cited

U.S. PATENT DOCUMENTS 5,743,784 A 4/1998 Birang et al.
6,224,464 B1 * 5/2001 Nojo ..... 451/41
6,306,008 B1 10/2001 Moore
6,306,009 B1 10/2001 Sandhu et al.

FOREIGN PATENT DOCUMENTS

JP 10-315124 12/1998

* cited by examiner

*Primary Examiner*—John F. Niebling
*Assistant Examiner*—Andre C Stevenson
(74) *Attorney, Agent, or Firm*—Antonelli, Terry, Stout & Kraus, LLP

(57) ABSTRACT

The present invention aims at make automatic real-time measurement of the removal rate in during polishing. For achieving the aim, a polishing system is provided with a sensor 1 for measuring a friction generated between a polishing pad and a workpiece during the polishing. The information processor of the polishing system evaluates the polishing efficiency of the polishing pad 5 on the basis of a fluctuation in the removal rate which is successively obtained from a friction successively detected by the sensor and a predetermined function. The result of the evaluation is used for the determination of the execution timing of a dressing process for the polishing pad, the calculation of the removal from the workpiece, and the like.

6 Claims, 5 Drawing Sheets

POLISHING METHOD

BACKGROUND OF THE INVENTION

1. Field of the Invention

The present invention relates to a technique for polishing the surface of a workpiece, and more particularly to a polishing method that can be suitably applied to planarization of a silicon wafer surface in a semiconductor manufacturing process.

2. Description of the Related Art

In a manufacturing process for fabricating a high density semiconductor integrated circuit element on the surface of a silicon wafer, steps are formed on the surface of the silicon wafer by the formation of a dielectric film, a metallic pattern or the like. If pattern formation is further carried out over the silicon wafer having the steps formed on the surface, for example, the depth of focus in lithography is caused to decrease, so that there is caused a drawback that a resolution becomes insufficient. For this reason, the wafer process employs a chemical mechanical polishing (CMP) technique for planarizing the steps of the device fabrication.

At the polishing step in the device fabrication, usually, a removal per unit time (hereinafter referred to as a removal rate) is periodically measured for grasping the degradation of the wafer polishing efficiency depending on the loss of sufficient surface roughness of the polishing pads or the like. More specifically, every time a predetermined number of silicon wafers are polished, a dummy wafer is polished, to detect a ratio m/T of a change m in a thickness of a silicon dioxide film formed on the surface of the dummy wafer (a difference in thickness obtained before and after the polishing) to a polishing time T, as a removal rate.

At the polishing step in the device fabrication, a value obtained by dividing a target removal by a removal rate thus calculated periodically is set to be a polishing time per silicon wafer. Consequently, there can be prevented a fluctuation in the removal caused by a deterioration in the polishing efficiency of a polishing pad. Further, when the removal rate comes to be smaller than a predetermined value during the polishing, the surface of the polishing pad (a surface used for polishing the silicon wafer) is dressed through a diamond disk or the like, so as to recover the polishing efficiency of the polishing pad which is deteriorated by the loss of sufficient surface roughness of the polishing pads or the like. A fluctuation in the removal rate can be therefore suppressed.

By a process utilizing the removal rate periodically calculated during the polishing, a fluctuation in the removal rate is suppressed and the time required for polishing the wafer is controlled depending on the removal rate. Therefore, the error of the removal from the wafer can be prevented.

In the periodic measurement of the removal rate utilizing the dummy wafer, it is difficult to make real-time detection of the removal rate which successively changes during the polishing. For this reason, it is possible to miss the optimum timing of a dressing process and the optimum timing of a process for correcting the time required for polishing might. Moreover, while the removal rate is measured through the dummy wafer, the polishing process of the wafer is interrupted, so that the manufacturing efficiency of a semiconductor device decreases to that extent.

SUMMARY OF THE INVENTION

The present invention provides a method of polishing workpieces, comprising the steps of:

relatively moving a polishing tool and a workpiece while causing the polishing tool and the workpiece to be in contact with each other, to polish the workpiece;

successively measuring a friction caused between the workpiece and the polishing tool during the polishing;

quantifying a characteristic of the polishing tool related to polishing efficiency of the polishing tool on the basis of on the friction when the friction is measured at the measuring step;

deciding whether or not a value obtained by quantification in the quantifying step is smaller than a predetermined reference value; and dressing the polishing tool when it is decided that that the value is smaller than the reference value in the deciding step.

DESCRIPTION OF THE PREFERRED EMBODIMENTS

An embodiment of the present invention will be described below with reference to the accompanying drawings.

First, the structure of the polishing apparatus according to the present embodiment will be explained. The polishing apparatus suitable for CMP in a device fabrication will be explained as a specific example.

Figure 1:
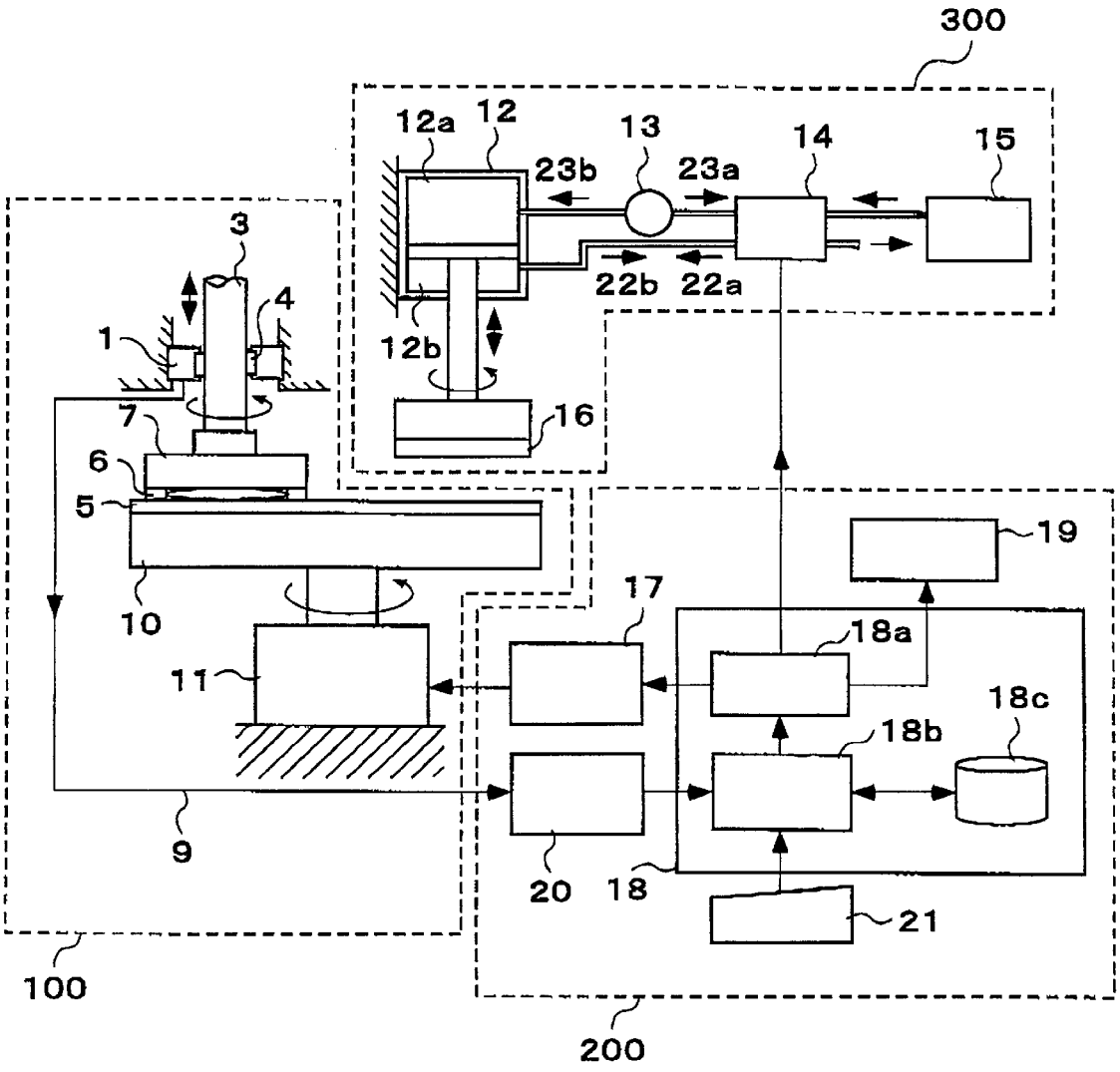
FIG. 1 is a schematic view showing the whole structure of a polishing system according to an embodiment of the present invention.

As shown in FIG. 1, the present polishing apparatus comprises a polishing section 100 for polishing a workpiece 6 with a polishing pad 5, a dressing section 300 for dressing the polishing pad 5, and a control section 200 for controlling the polishing section 100 and the dressing section 300. The structure of each section is as follows.

The polishing section 100 is constituted by a platen 10 having the polishing pad 5 attached thereto, a nozzle (not shown) for supplying a slurry toward the polishing pad 5, a motor 11 for rotating the platen 10, a chuck 7 for holding the workpiece 6, a spindle 3 for rotating the chuck 7 while pressing the workpiece 6 to the polishing pad 5, a bearing 4 for rotatably holding the spindle 3, a motor (not shown) for rotating the spindle 3, a sensor 1 for detecting a friction between the polishing pad 5 and the workpiece 6, and the like. In general, the direction of a friction 8 between the polishing pad 5 and the workpiece 6 is varied depending on a distance between the center of rotation of the polishing pad 5 and the workpiece 6. Preferably, the sensor 1 to be used should therefore detect forces (component forces of the friction) acting in two orthogonal directions included in the surface of the polishing pad 5 (a surface orthogonal to the spindle 3) and should detect their resultant force as a friction.

In such a structure, a relative motion is given to the workpiece 6 and the polishing pad 5 while generating a proper polishing pressure between the workpiece 6 and the polishing pad 5, so that the workpiece 6 can be polished with the polishing pad 5 and that the real-time measurement of the friction acting between the workpiece 6 and the polishing pad 5 can be made can be measured by the sensor 1 during the polishing.

The dressing section 300 is constituted by a diamond disk 16 for dressing the polishing pad 5, a motor (not shown) for rotating the diamond disk 16, an air cylinder 12 for applying a dressing pressure to the diamond disk 16, an air compressor 15 for supplying air to the air cylinder 12, a pipe for connecting two chambers 12*a* and 12*b* of the air cylinder 12 to the air compressor 15 or the outside (atmosphere), a valve 14 provided on pipes 22 and 23, a pressure regulator 13 for controlling a dessing pressure acting between the polishing pad 5 and the diamond disk 16, and the like.

In such a structure, the polishing pad 5 deteriorated by the execution of the polishing can be dressed with the diamond disk 16 under the control of the control section 200. Specifically, when a first control instruction is given from the control section 200, the valve 14 responds to the instruction to open a line 23*b* provided from the air compressor 15 to one chamber 12*a* of the air cylinder 12 and a line 22*b* provided from the other chamber 12*b* of the air cylinder 12 to the outside, whereby a piston is moved forward such that the rotating diamond disk 16 is pressed to the rotating polishing pad 5, to start dressing of the polishing pad 5. Upon the start of the dressing of the polishing pad 5, the pressure regulator 13 responds to a control instruction from the control section 200 to control a polishing pressure acting between the polishing pad 5 and the diamond disk 16. When a second operation instruction is given from the control section 200 while the polishing pad 5 is dressed, the valve 14 responds to the instruction to open a line 23*a* provided from the chamber 12*a* of the air cylinder 12 to the outside and a line 22*a* provided from the air compressor 15 to the chamber 12*b* of the air cylinder 12, whereby the piston is moved backward such that rotating diamond disk 16 is separated from the rotating polishing pad 5, and the dressing of the polishing pad 5 is completed.

The control section 200 is constituted by a motor controller 17 for controlling the motor of the polishing section 100, a motor controller (not shown) for controlling the motor of the dressing section 300, an A/D converter 20 for digitally converting an output signal 9 of the sensor 1, an information processor 18 for executing a polishing efficiency evaluating process which will be described below, a control process of the whole polishing apparatus and the like, an input device (a keyboard or the like) 19 for accepting various setting data (the target value of the removal or the like) required for the execution of the polishing which are inputted from a user, a display device 19 for displaying data (the result of the polishing efficiency evaluating process or the like) outputted from the information processor 18, and the like. The above information processor 18 has a hardware that is an ordinary computer in which a CPU (not shown) executes a program loaded onto a memory 18*c*, and carries out loading and execution of an evaluation program defining the polishing efficiency evaluating process to be described later and a processing program defining the above dressing, etc., to implement two functional structure sections (a calculation processing section 18*b* for executing a polishing efficiency evaluating process and a removal calculating process and a control processing section 18*a* for giving a control instruction to the polishing section 100 and the dressing section 300) as a process.

The polishing efficiency evaluating process and the removal calculating process, which the information processor 18 executes during the polishing, will be explained below. As a specific example, there will be described the case using, as a workpiece 6, a silicon wafer (a diameter of 150 mm) provided with a silicon dioxide film having a thickness of approximately 2 $\mu$m.

Figure 2:
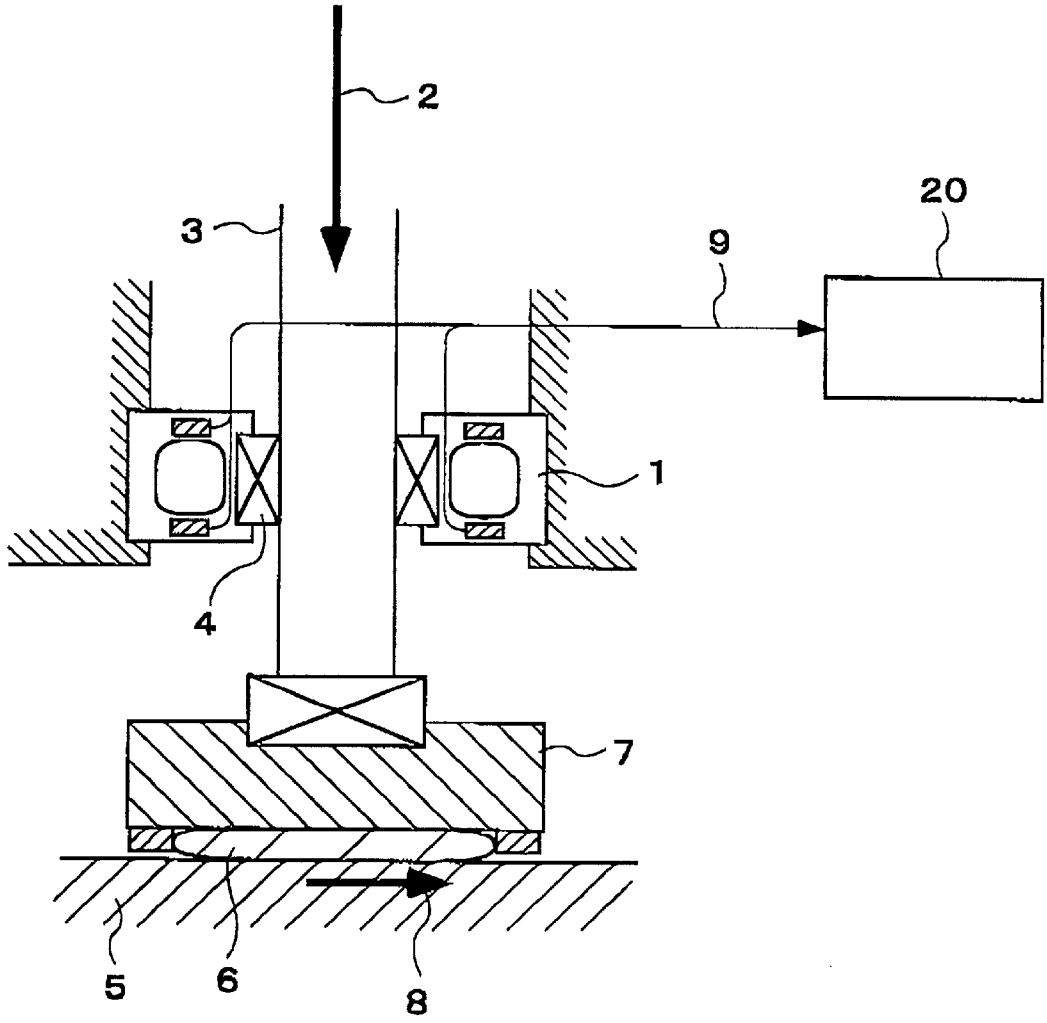
FIG. 2 is a partial cross-sectional view showing a polishing portion of the polishing system in FIG. 1.

As shown in FIG. 2, while the silicon wafer 6 is polished, that is, while a polishing pressure 2 is generated between the silicon wafer 6 and the polishing pad 5 by allowing both of them to slide, the friction 8 is generated between the polishing pad 5 and the silicon wafer 6. The friction 8 is successively detected by the sensor 1 through the chuck 7, the spindle 3 and the bearing 4. A signal 9 successively outputted from the sensor 1 is digitally converted by the A/D converter 20 and is then inputted successively to the information processor 18. Every time the calculation processing section 18*b* of the information processor 18 inputs a signal from the A/D converter 20, it sequentially executes the polishing efficiency evaluating process and the removal calculating process based on the signal as will be described below.

First, the calculation processing section 18*b* calculates the current removal rate on the basis of a friction indicated by the signal inputted from the A/D converter 20. Specifically, a current removal rate k(t) of the polishing pad is calculated from the detected value of the friction by using a function f for determining the removal rate from the friction.

The above function f is pre-created on the basis of measurement data obtained in a polishing experiment carried out under the same process conditions as the process conditions to be used for actual polishing, and the function f is incorporated into the evaluation program. The present embodiment uses the following process conditions for the actual polishing, and the friction and the removal rate were therefore measured by carrying out the polishing experiment under the same process conditions.

(1) Work piece (Silicon wafer)

| | |
|---|---|
| Diameter | : Approximately 150 mm |
| Polished film | : Silicon dioxide film having |

thickness of approximately 2 $\mu$m (2)

| | |
|---|---|
| Rotation speed | : 126 rad/min |
| Polishing pad | |
| Thickness | : Approximately 1 mm |
| Main component | : Polyurethane foam |

having a compression elastic modulus of approximately 100 Mpa (3)
(4)

| | |
|---|---|
| Rotation speed | : approximately 300 mm/s |
| Slurry (containing abrasive grains) | : $SiO_2$ |
| Abrasive grains | |
| Content of abrasive grains | : approximately 3 wt % |
| Feed rate: | : 100 ml/min |
| Polishing pressure | : 500 g/cm$^2$ |

Figure 4:
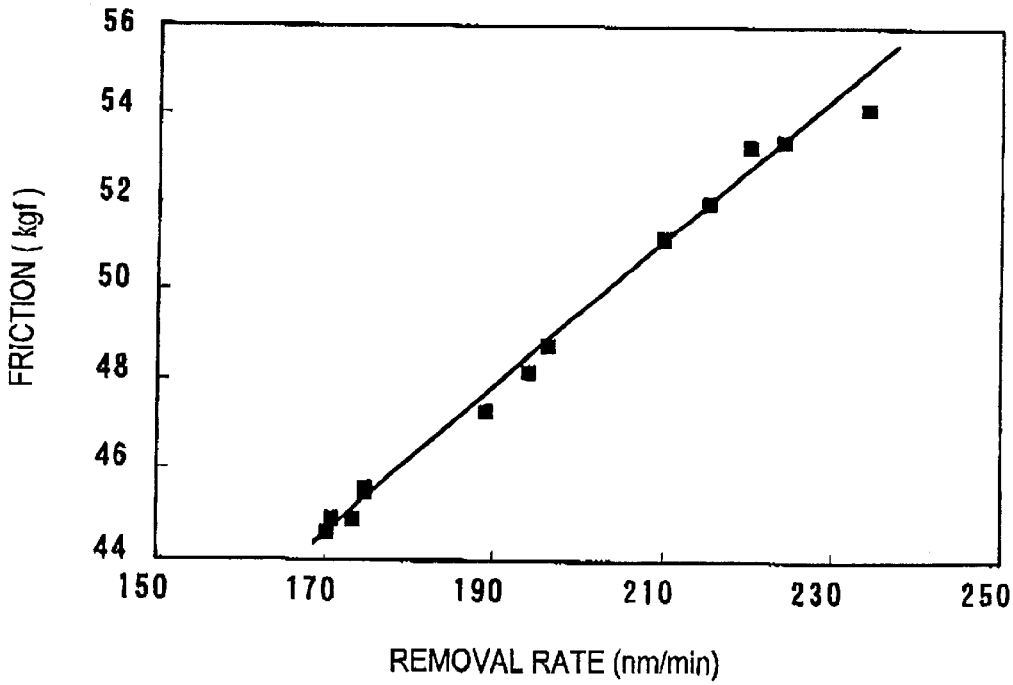
FIG. 4 is a chart showing the relationship between the friction and the removal rate.

By plotting the friction and the removal rate measured in the polishing experiment under the above process conditions, a graph shown in FIG. 4 was obtained. The graph shows that a measured data point group obtained by the polishing experiment was almost positioned on a straight line. In the present embodiment, therefore, the removal rate is caused to approximate through the linear function of the friction by a least-squares method, and the linear function is set to be the above function f to be used by the calculation processing section 18*b*. If the process conditions used for the polishing experiment are changed, the function f obtained from the measured data is also varied. When the process conditions to be used for the actual polishing are changed, therefore, it is necessary to reset the function f by renewing the experiment or to correct the function f according to the changed process conditions.

Figure 3:
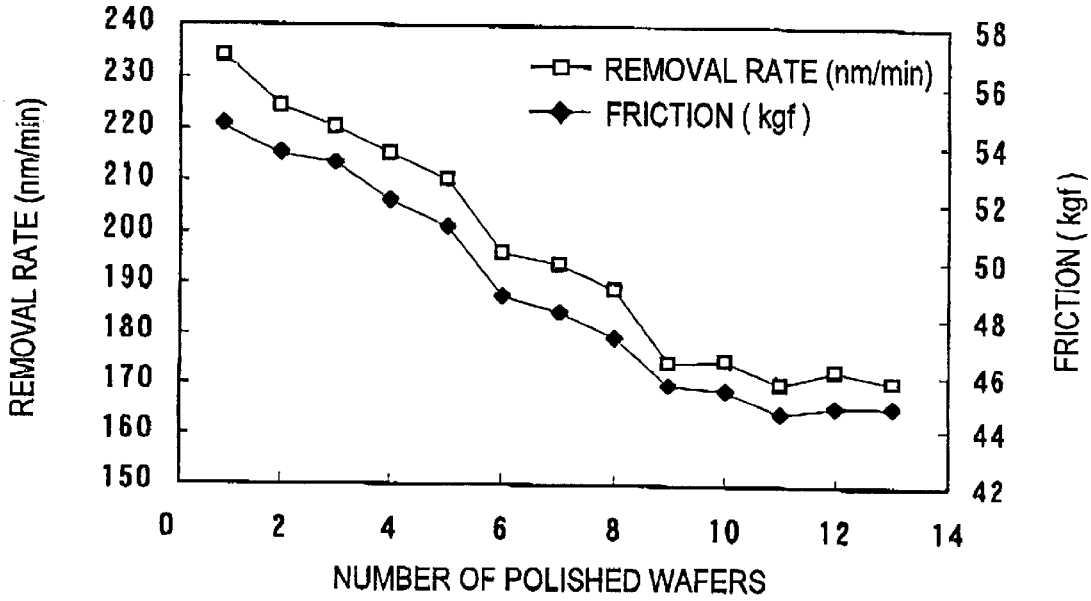
FIG. 3 is a chart showing correlations of a removal rate and a friction to the total number of silicon wafers to be polished.

When the removal rate k(t) is calculated by using the function f thus determined, the removal rate k(t) of the polishing pad decreases together with a friction that decreases due to the loss of sufficient surface roughness of the polishing pad with an increase in the number of silicon wafers to be polished, as is shown in FIG. 3. The calculation processing section 18*b* evaluates the polishing efficiency of the polishing pad 5 on the basis of the removal rate k(t). Specifically, the calculation processing section 18*b* compares a predetermined reference value with the removal rate k(t). If the removal rate k(t) is smaller than the reference value it is evaluated that the polishing efficiency of the polishing pad 5 is deteriorated. If the removal rate k of the polishing pad is equal to, or greater than, the reference value, it is evaluated that the polishing efficiency of the polishing pad 5 is recovered. The results of the evaluation are displayed on a display device 19.

When the polishing efficiency evaluating process is thus completed, the calculation processing section 18*b* calculates a removal $\upsilon k(t)dt$ of the silicon wafer from the start of the polishing to a current point from the removal rate k(t) calculated in the polishing efficiency evaluating process. The removal rate k(t) and the removal $\upsilon k(t)dt$ calculated at this time is displayed on the display device 19.

The polishing to be executed by the polishing system in FIG. 1 will be explained below. In the polishing to be carried out, the above process conditions (1) to (4) are employed.

Figure 7:
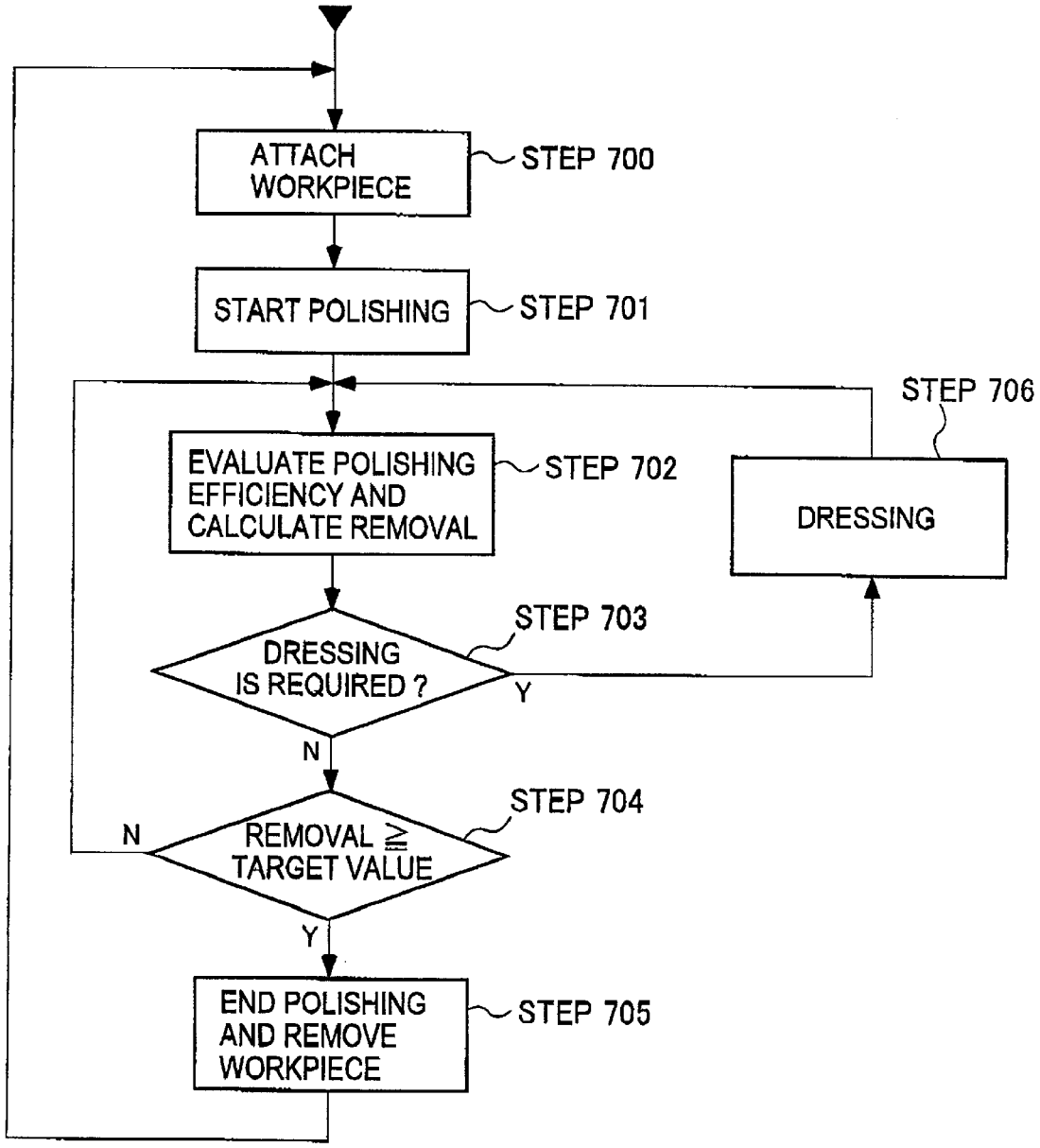
FIG. 7 is a flow chart showing a polishing step according to the embodiment of the present invention.

FIG. 7 is a flow chart showing the polishing process using the polishing system in FIG. 1.

When the silicon wafer 6 is attached to the chuck 7 (Step 700), the supply of a slurry to the polishing pad 5 is started. Then, the motor controller 17 rotates the platen 10 and the spindle 3 in response to a control instruction sent from the control processing section 18*a* of the information processor 18. Consequently, the polishing pad 5 and the silicon wafer 6 are slid to start to polish the silicon dioxide film formed on the surface of the silicon wafer (Step 701).

While the silicon wafer 8 is thus polished, a friction generated between the silicon wafer 6 and the polishing pad 5 is successively detected by the sensor 1 and a signal 9 outputted from the sensor 1 is successively inputted to the information processor 18 through the A/D converter 20. The calculation processing section 18*b* of the information processor 18 executes the polishing efficiency evaluating process and the removal calculating process every time the signal is inputted through the A/D converter 20 (Step 702).

Further, every time the polishing efficiency evaluating process and the removal calculating process are completed, the information processor 18 carries out the following process.

First, the calculation processing section 18*b* of the information processor 18 decides whether or not the dressing of the polishing pad 5 is required (Step 703). Specifically, when the calculation processing section 18*b* of the information processor 18 decides that the polishing efficiency of the polishing pad 5 is deteriorated in the polishing efficiency evaluating process, it is decided that the dressing of the polishing pad 5 is required. When the calculation processing section 18*b* of the information processor 18 decides that the polishing efficiency of the polishing pad 5 is recovered in the polishing efficiency evaluating process, it is decided that the dressing of the polishing pad 5 is not required.

When it is decided that the dressing of the polishing pad 5 is not required, the calculation processing section 18*b* of the information processor 18 decides whether or not the removal calculated in the removal calculating process is equal to, or greater than, a target removal preset by a user (Step 704). If the removal calculated in the removal calculating process is equal to, or greater than, the target removal preset by the user, the motor controller 17 stops the rotation of the platen 10 and the rotation of the spindle 3, to complete the polishing of the silicon wafer which is being polished, in response to the control instruction sent from the control processing section 18*a* of the information processor 18. Then, the supply of the slurry to the polishing pad 5 is also stopped and the silicon wafer 6 is removed from the chuck 7 (Step 705). If the removal calculated in the removal calculating process is to the contrary, or smaller than the target removal preset by the user, the polishing of the silicon wafer which is being polished is continued.

On the other hand, when it is decided that the dressing of the polishing pad 5 is required, the calculation processing section 18*b* of the information processor 18 gives a first control instruction to the valve 14 to start the dressing process for the polishing pad 5 (Step 706). While the dressing process is carried out, the calculation processing section 18*b* of the information processor 18 not only gives a control signal to the pressure regulator thereby to control a polishing pressure between the polishing pad 5 and the diamond disk but also executes the above polishing efficiency evaluating process to decide whether or not the polishing efficiency of the polishing pad 5 is recovered every time a signal is inputted from the sensor 1 through the A/D converter 20. If it is decided that the polishing efficiency of the polishing pad 5 is recovered, the calculation processing section 18*b* of the information processor 18 gives a second control instruction to the valve 14 to complete the dressing process for the polishing pad 5, so that the process is returned to the Step 702.

The above polishing makes it possible to make automatic real-time measurement of the successively changing removal rate without interrupting the polishing, so that the following effects can be obtained.

(a) The polishing needs no interruption, so that the efficiency of the polishing step can be enhanced as compared with the case using a dummy wafer to periodically measure the removal rate. As a result, the productivity of a semiconductor device can be enhanced.

(b) It is possible to accurately grasp the removal rate which changes successively with the progress of the polishing. Therefore, the dressing process for the polishing pad can be carried out in a proper timing. As a result, the polishing efficiency of the polishing pad can be maintained at an almost constant level.

(c) It is possible to use the removal rate detected in real time for the calculation of the removal from the workpiece, so that the removal from the workpiece can be calculated more accurately. It is therefore possible to decrease a difference between a target removal and an actual removal. The effect can enhance the finish accuracy of the workpiece together with the effect (b). For example, if the polishing step according to the present embodiment is employed for a wafer process, the performance of an LSI as an end product can further be enhanced.

The above effects (a), (b) and (c) will be verified.

The already described process conditions (1) to (4) were employed to carry out a polishing step according to the present embodiment and a polishing step using the dummy wafer to periodically measure the removal rate (which will be referred to as conventional polishing) . A target removal in each polishing step was set for 1 $\mu$m.

In each polishing step, 100 silicon wafers were continuously polished to measure the removal from each silicon wafer and a required time. In the conventional polishing, every time 10 silicon wafers were polished, the removal rate was measured by using the dummy wafer, and on the basis of the result of the measurement, the time required for the polishing is corrected.

Figure 6:
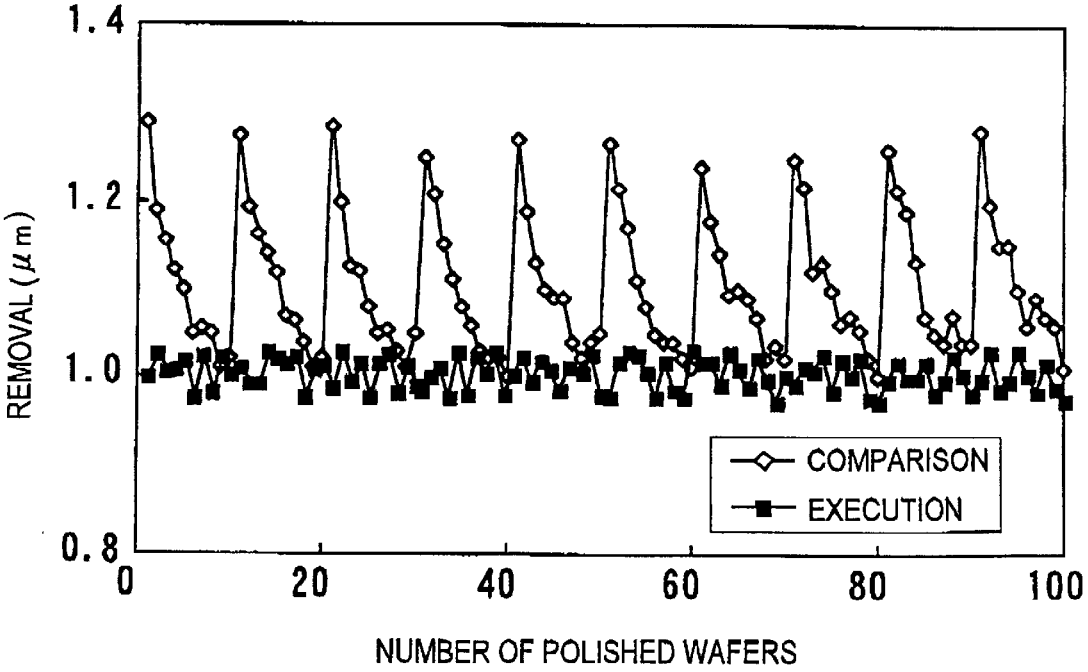
FIG. 6 is a chart showing effects obtained by using the polishing apparatus according to the embodiment of the present invention.

As a result, as shown in FIG. 6, the removal from the silicon wafers polished by the conventional polishing had a variation of approximately ±0.15 $\mu$m, while the removal from the silicon wafers polished by the polishing according to the present embodiment had a variation of approximately ±0.03 $\mu$m. This implies that in the polishing according to the present embodiment, the dressing process for the polishing pad is executed in a proper timing and the polishing efficiency of the polishing pad is maintained to have an almost constant level. That is, it implies that the polishing according to the present embodiment can produce the effect (b).

Further, the conventional polishing took approximately 1,400 minutes for polishing the 100 silicon wafers, while the polishing according to the present embodiment took approximately 500 minutes for polishing the 100 silicon wafers. This implies that the polishing according to the present embodiment is efficient, or that the effect (a) can be produced.

Moreover, 25 silicon wafers were continuously polished according to each polishing, to measure the removal from each silicon wafer. Also in each polishing, no dressing process for the polishing pad 5 was carried out.

Figure 5:
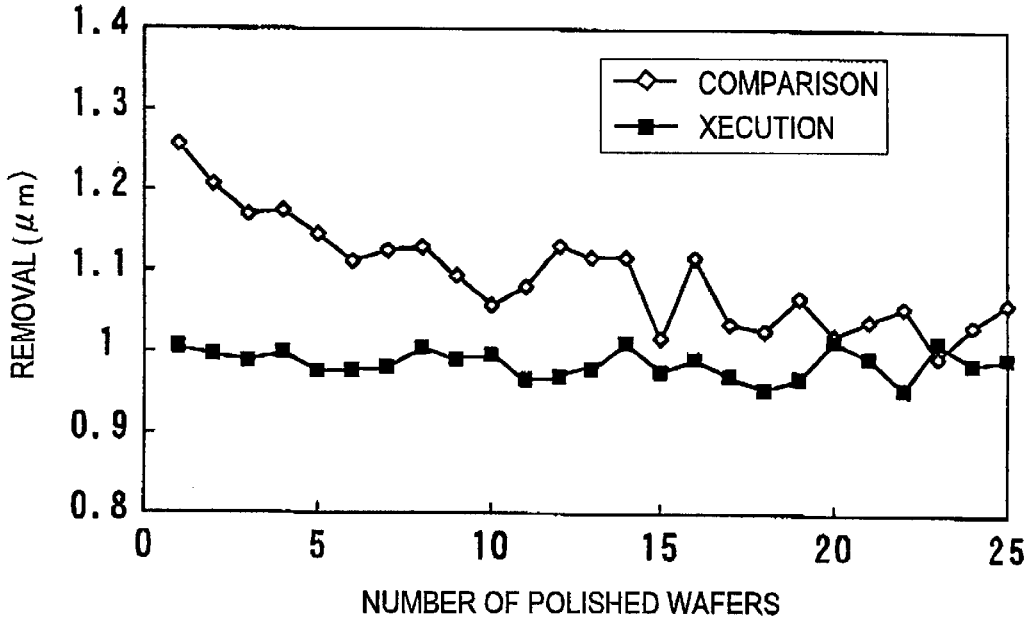
FIG. 5 is a chart showing effects produced by a polishing apparatus according to the embodiment of the present invention.

As a result, as shown in FIG. 5, the removal from the silicon wafers polished by the conventional polishing had a variation of approximately ±0.15 $\mu$m, while the removal from the silicon wafer polished by the polishing according to the present embodiment had a variation of approximately ±0.03 $\mu$m. This implies that the polishing according to the present embodiment decreases a difference between a target removal and an actual removal. That is, it implies that the polishing according to the present embodiment can produces the effect (c).

The foregoing confirms that the effects (a), (b) and (c) can be obtained by the present invention.

While the above embodiment employs a constitution in which the information processor 18 controls the controller 17 and the valve 14, it is not always required to employ such a constitution. For example, there may be employed a constitution in which an operator decides the timing of the dressing process and that of the end of the polishing, respectively, on the basis of information displayed on the display device 19 and manually operates the controller 17 and the valve 14.

Moreover, while the above embodiment uses, as a workpiece, the silicon wafer having one film formed thereon, a silicon wafer having two or more films stacked thereon may be used as a workpiece. When the material of the film being polished is changed, a friction detected by the sensor 1 varies, so that it is possible to detect the interface between adjacent films by monitoring the output of the sensor 1. When the silicon wafer having two or more films stacked thereon is a workpiece, there may be employed a constitution in which the removal from the film is controlled film after film.

Furthermore, while the above embodiment explains the polishing of the silicon wafer as an example of the application of the present invention, the present invention may be applied to the polishing of a workpiece other than the silicon wafer. Moreover, the process conditions described above are illustrative and do not need to be used as shown.

What is claimed is:

1. A method of polishing workpieces, comprising the steps of polishing a surface of a workpiece with a polishing tool;

successively measuring a friction caused between the workpiece and the polishing tool during the polishing;

quantifying a characteristic of the polishing tool related to polishing efficiency of the polishing tool on the basis of the friction when the friction is measured at the measuring step;

deciding whether or not a value obtained by quantification in the quantifying step is smaller than a predetermined reference value; and controlling a start of dressing the polishing tool when the value obtained by quantification is smaller than the reference value at the deciding step, and a termination of dressing of the polishing tool when the value obtained by quantification is not smaller than the reference value at the deciding step.

2. The polishing method according to claim 1, wherein the measuring step is carried out during the polishing step.

3. The polishing method according to claim 1, wherein a removal rate of the polishing tool is calculated as the value at the quantifying step, the polishing method further comprising the step of:

repeatedly carrying out the quantifying step to calculate repeated removal rates, calculating a removal from the workpiece on the basis each of the removal rates calculated at the quantifying step and controlling a relative movement of the polishing tool and the workpiece depending on the removal.

4. The polishing method according to claim 2, wherein a removal rate of the polishing tool is calculated as the value at the quantifying step, the polishing method further comprising the step of:

repeatedly carrying out the quantifying step to calculate repeated removal rates, calculating a removal from the workpiece on the basis each of the removal rates calculated at the quantifying step and controlling a relative movement of the polishing tool and the workpiece depending on the removal.

5. A polishing method according to claim 1 wherein a removal rate is calculated as the value at the quantifying step, said polishing method further comprising the steps of:

detecting a time of exposure of an interface between a first layer made of a first material and a second layer made of a second material of a workpiece, when polishing the workpiece that comprises the first layer to be polished first and the second layer, based on the friction measured at the measuring step; and calculating a removal from the second layer from the time of exposure detected by the detecting step and the second layer removal rate successively calculated by the quantifying step;

wherein at the controlling step, the relative movement is controlled in accordance with the second layer removal calculated by the calculation step.

6. A polishing method according to claim 2, wherein a removal rate is obtained as the value at the quantifying step, said polishing method comprising steps of:

detecting a time of exposure of an interface between a first layer made of a first material and a second layer made of a second material of a workpiece, when polishing the workpiece that comprises the first layer to be polished first and the second layer, based on the friction measured at the measuring step; and calculating a removal from the second layer from the time of exposure detected by the detecting step and the second layer removal rate successively calculated by the quantifying step;

wherein at the controlling step, the relative movement is controlled in accordance with the second layer removal calculated by the calculation step.

* * * * *